United States Patent [19]

Matte

[11] Patent Number: 5,076,646

[45] Date of Patent: Dec. 31, 1991

[54] ONE-PIECE SHELL FOR A CHAIR

[76] Inventor: Denis Matte, 2928, de la Promenade Ste-Foy, Quebec, Canada, G1W 2J4

[21] Appl. No.: 517,132

[22] Filed: May 1, 1990

[51] Int. Cl.[5] ..... A47C 7/02

[52] U.S. Cl. ..... 297/457; 297/353

[58] Field of Search ..... 297/457, DIG. 2, 306, 297/285, 297, 353

[56] References Cited

U.S. PATENT DOCUMENTS

| | | | |
|---|---|---|---|
| 2,808,875 | 10/1957 | Bargen | 297/DIG. 2 |
| 3,133,765 | 5/1964 | Kramer | 297/457 |
| 3,302,276 | 2/1967 | Williams et al. | 297/DIG. 2 |
| 3,883,176 | 5/1975 | Morton | 297/457 |
| 3,904,243 | 9/1975 | Kostelec et al. | 297/DIG. 2 |
| 4,032,190 | 6/1977 | Muller-Deisig et al. | 297/353 |
| 4,630,864 | 12/1986 | Toll | 297/452 |

FOREIGN PATENT DOCUMENTS

| | | |
|---|---|---|
| 928628 | 6/1973 | Canada . |
| 1217705 | 2/1977 | Canada . |

*Primary Examiner*—Laurie K. Cranmer
*Assistant Examiner*—James M. Gardner

[57] ABSTRACT

A one-piece molded seating shell for use in the construction of a chair. The shell is molded from composite polymeric materials, and comprises a seating portion and a back support portion interconnected therewith by a single, central, narrow intermediate integrally formed joint. At least the joint is provided with reinforcing fibers extending therein and permits the back support portion to flex rearwardly of its normal plane and in torsion.

5 Claims, 2 Drawing Sheets

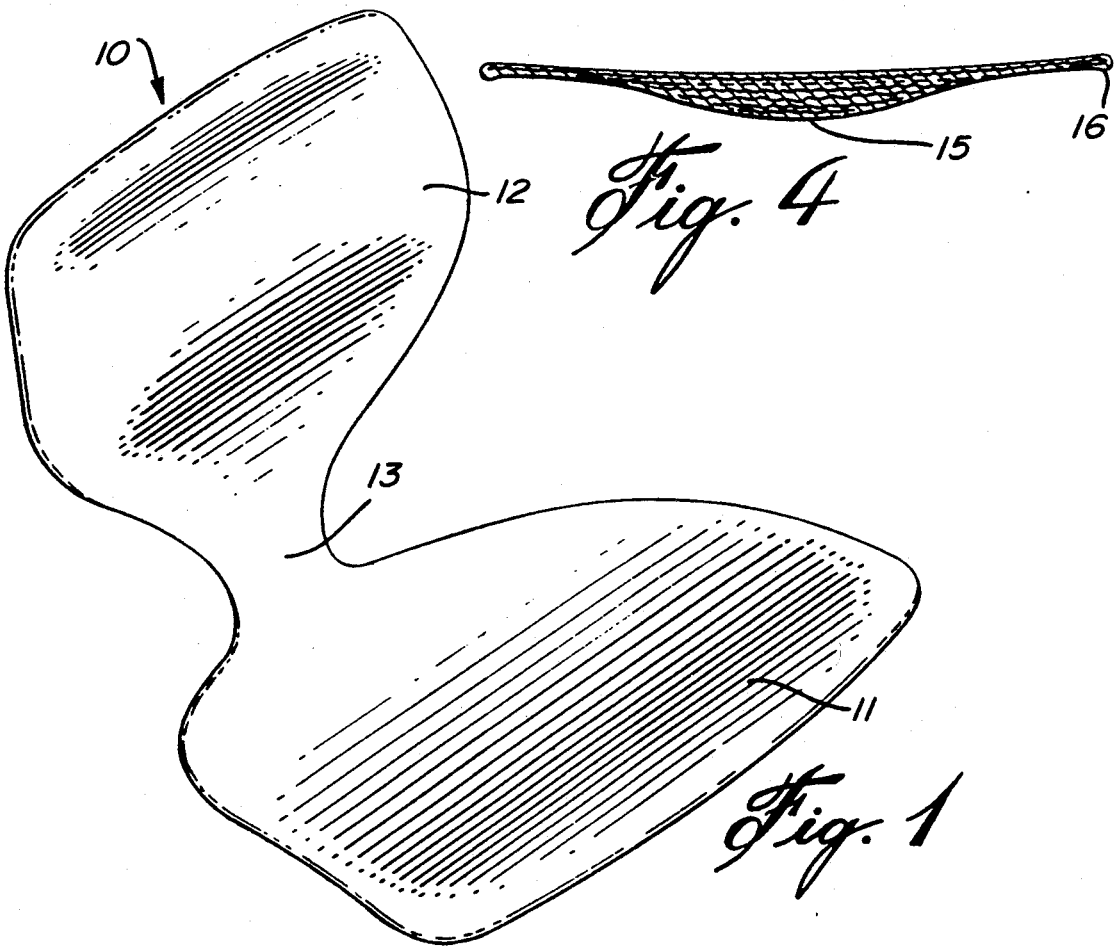
Fig. 4
Fig. 1
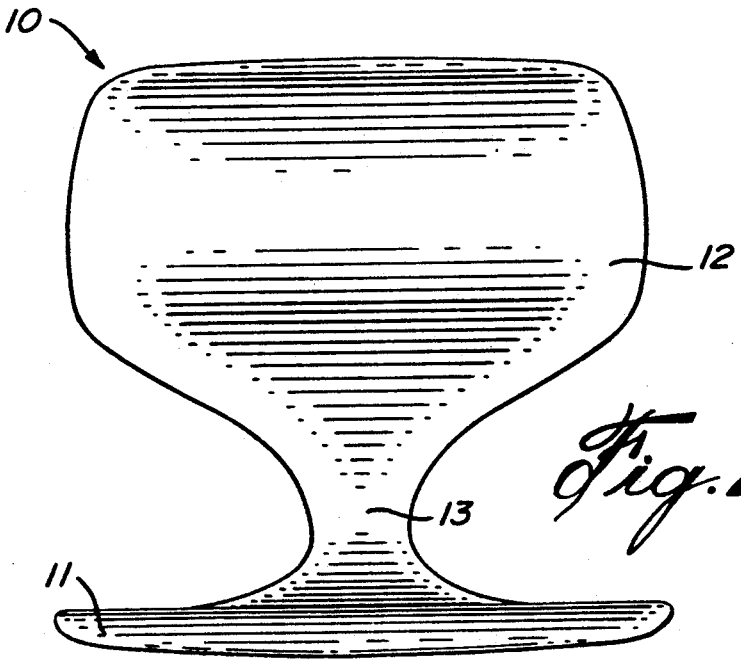
Fig. 2

ONE-PIECE SHELL FOR A CHAIR

BACKGROUND OF INVENTION

1. Field of Invention

The present invention relates to a one-piece molded seating shell for use in the construction of a chair, and wherein the chair has a back support portion and a seating portion interconnected by a narrow intermediate joint formed integral therewith to provide for the back portion to flex rearwardly and in torsion. More specifically, the shell is formed from composite polymeric materials reinforced with fibers.

2. Description of Prior Art

It is known to provide a one-piece molded seating shell of which the back portion can flex rearwardly. For example, reference is made to Canadian Patent 1,217,705 which refers to such a structure. The present invention relates to an improved shell of the type as described in that patent, and which gives better flexing and torsion properties without the use of any mechanical device and with a unique functional design.

In Canadian Patent No. 928,628, there is disclosed a support frame which permits a shell to be non-rigidly mounted so as to be subject to flexural and torsional stresses and strains during use. With the invention disclosed herein, there is no need to mount the shell on flexible bushings to achieve torsional displacement of the back rest. This is achieved by the shell structure and therefore the shell does not require any external back support.

According to the above features, from a broad aspect, the present invention provides a one-piece molded seating shell for use in the construction of a chair. The shell is molded from composite polymeric materials and comprises a seating portion and a back support portion interconnected therewith by a single, central, narrow intermediate integrally formed joint. At least the joint has reinforcing fibers extending therein and permitting the back support portion to flex rearwardly and in torsion.

BRIEF DESCRIPTION OF DRAWINGS

A preferred embodiment of the present invention will now be described with reference to the preferred embodiment as illustrated in the accompanying drawings, in which:

FIG. 1 is a perspective view of the one-piece molded seating shell of the present invention;

FIG. 2 is a front view of the seating shell;

FIG. 4 is a section view across the joint along section line 4—4 of FIG. 5;

DESCRIPTION OF PREFERRED EMBODIMENTS

It is well known that when the human body is in a seating position it is constantly adjusting itself on its seat in order to alleviate tension that exists in the lower part of the back. The human body is most often in movement and, in order to alleviate or release these tensions in the bottom of the back, the body cannot be restrained when seated. Therefore, when seated, the back support surface must permit these automatic body movements to be effectuated. It is also a well known fact that chairs having rigid backrests are often the cause of lower back problems. Various chair constructions have therefore been developed which utilize mechanical or electromechanical systems, which are complex and expensive, in order to permit the backrest of the chair to be displaced in response to body movement.

SUMMARY OF INVENTION

It is a feature of the present invention to provide a one-piece seating shell molded from composite polymeric material, and wherein the back portion and the seating portion are integrally connected by a single, central, narrow intermediate joint which permits the back portion to be displaced rearwardly and in torsion whereby to overcome the abovementioned disadvantages of the prior art.

Another feature of the present invention is to provide a unique functional design for a one-piece molded seating shell which is molded from composite polymeric materials and reinforced with fibers, at least in the intermediate joint formed integral with the back portion and seating portion of the shell.

Referring now to FIGS. 1 to 6, there is shown generally at 10 the one-piece seating shell of the present invention which is used for the construction of a chair. The shell is molded from composite polymeric materials having reinforcing fibers therein, and defines a seating portion 11, a back support portion 12, and an intermediate integrally formed joint 13. The joint 13 permits the back portion 12 to flex rearwardly, as shown at phantom lines 12' in FIG. 5, and also in torsion along its normal plane as illustrated by arrow 14 in FIG. 3.

Figure 6:
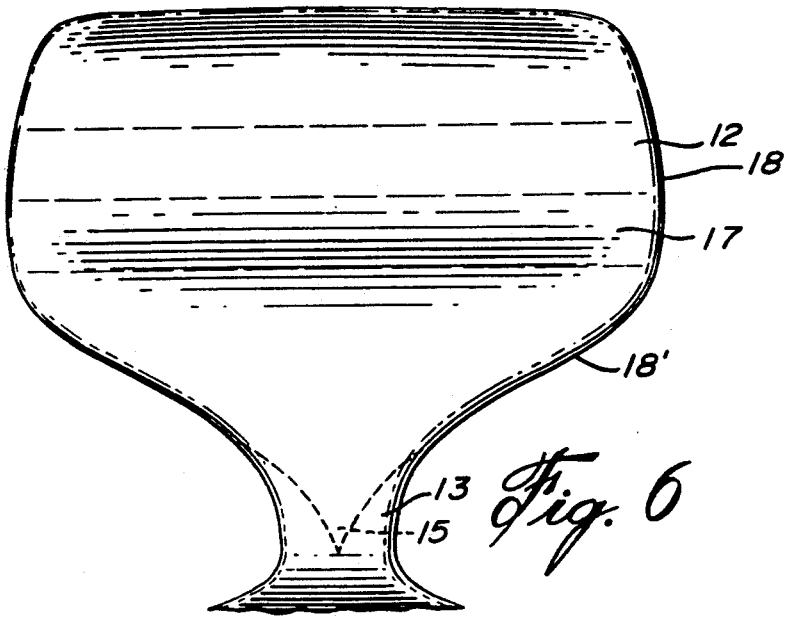
FIG. 6 is a front view of the back support portion.

When molding the seating shell, reinforcing fibers such as glass fibers, carbon fibers, or other suitable fibers, are disposed within the mould and polymeric material is injected all about the fibers and throughout the shell cavity in the mould. However, in order for the joint to resist the loads imposed thereon by a person seated on the shell and subjecting the back rest to flexion and torsion, the joint is reinforced with a higher distribution of fibers therein with the fibers extending into the seating and back support portions. Consequently, the joint is made thicker than the average thickness of the back portion and the seating portion, and in this respect, is thicker than the back and seating portions. This thickness is dependent on the type and disposition of the fibers. In fact, the joint has a distribution of reinforced fibers of about from 48 to 100 oz/yard (with the Example described herein). The total composition of the joint may include, for example only, from between 25% to 60% of reinforced fibers. As also seen in FIG. 6, the joint has a width which is about 1/5 the total width of the back or seating portions, and the thickness of the joint tapers progressively with the back and seating portions to eliminate strain points therein.

Also, as can be seen in FIG. 4, the joint, when viewed in cross-section on a transverse horizontal plane, is thicker at the center thereof, as designated by numeral 15, and tapers to the outer edges 16. The outer edges are also beaded to provide a smoother edge for the shell.

Generally, the shell resembles a figure-8 configuration with the back portion 12 and seating portion 11 having substantially equal lengths from the center of the joint.

Figure 3:
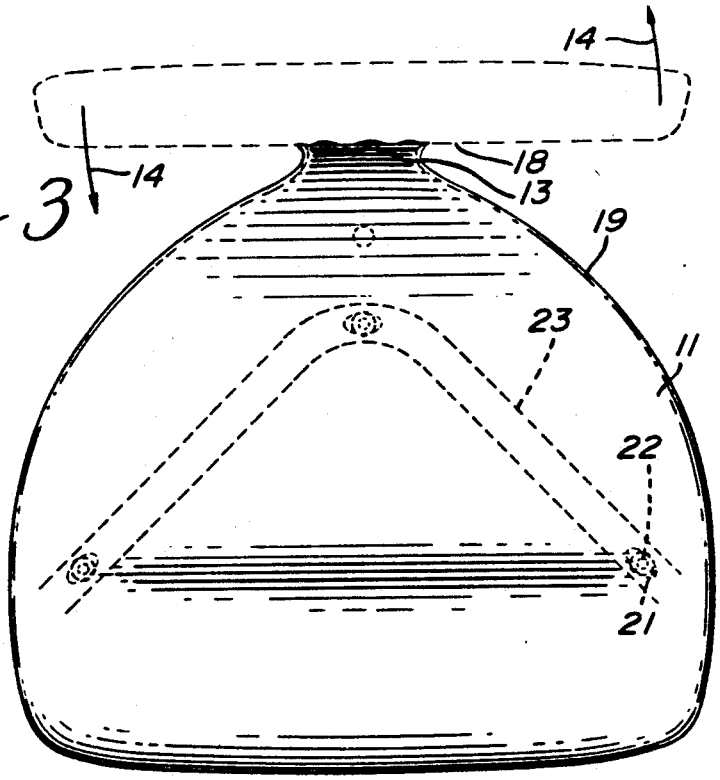
FIG. 3 is a top plan view of the sealing portion.
Figure 5:
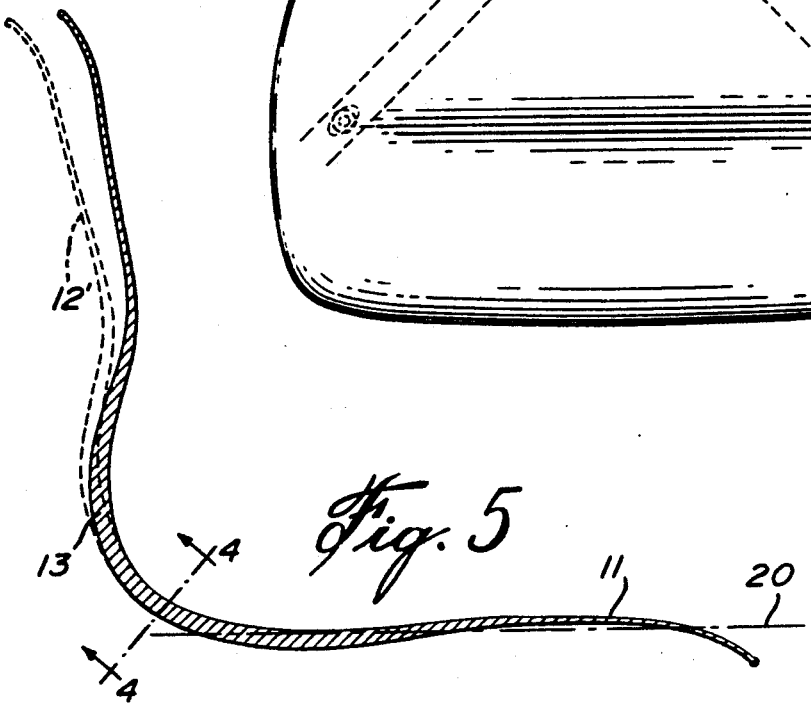
FIG. 5 is a transverse section view of the shell as shown in FIG. 1 and showing the configuration of the back support portion.

The back portion 12 defines opposed wing sections 17 which are defined by opposed curvilinear concave side edges 18 which, in a lower section thereof 18', taper progressively into the integrally formed joint 13. The seat portion 11 also interconnects with the joint 13 along opposed curved edges 19 which merge into the side edges 18 of the back portion through the joint 13. As shown in FIG. 5, the joint 13 is also disposed above the horizontal plane 20 which passes through the seating portion 11.

In order to secure the shell to a chair support frame, the seating portion 11 is formed with fastener receiving cavities 21 each having a through hole 22 therein. A tubular support frame, such as 23 or any other frame, may thus be connected to the seating portion to support the shell elevated on a floor surface, either on fixed legs or on legs equipped with casters.

In a preferred embodiment of construction of the seating shell 10 of the present invention, the joint 13 has a width of 1 to 3 inches and the thickness of the shell varies from ⅛ in. in the back portion to 1 inch in the joint portion. The following table sets forth a proposed disposition and composition of fibers within the shell.

EXAMPLE

| No. of Layers | Type of Fibers | oz/yd$^2$ | Dimension |
|---|---|---|---|
| 1 | U.D. | 12 oz | 3" × 22" |
| 1 | C.S.M. | 2.0 oz | throughout entire shell |
| 1 | U.D. | 12 oz | 2.25" × 15" |
| 2 | U.D. | 12 oz | 1.5" × 9" |
| 1 | U.D. | 12 oz | 2.25" × 15" |
| 1 | C.S.M. | 2.0 oz | throughout entire shell |
| 1 | U.D. | 12 oz | 3" × 22" |

U.D. = unidirectional
C.S.M. = continuous strand mat

The flexion of the back portion 12 has been tested, and it has been noted that with a person seated on the shell in an ideal position (equivalent to a load of about 12.6 kg on the back portion), the deflection of the back portion was about 4.9 cm. This deflection can vary in accordance with the composition of the molded shell. The thickness of the molded shell varies in accordance with the intended use of the shell, i.e., if the shell is to be used as a secretary chair, a desk chair, or a stationary chair. The torsional deflection was also measured, and it was found that with a torsional load of about 12.6 kg on the back portion, the wing sections 17 deflected about 5 cm. This displacement in torsion can also vary depending on the type of shell molded, that is to say, the thickness of the polymeric material, and the amount of fibers disposed therein. Typically, the shell may be molded from polyurethane or polyurea resins.

It is within the ambit of the present invention to cover any obvious modifications of the preferred embodiment described herein, provided such modifications fall within the scope of the appended claims.

I claim:

1. A one-piece molded flat seating shell for use in the construction of a chair, said shell being molded from composite polymeric materials with reinforcing fibers distributed therein, said shell defining a seating portion and a back support portion interconnected therewith by a single, central, narrow intermediate integrally formed joint; said joint being thicker than said seating and back portions and having a higher distribution of reinforcing fibers extending therein and permitting said back support portion to flex rearwardly and in torsion, said seating shell when viewed in a transverse vertical plane is thicker in said joint and tapers progressively within said back and seating portions, said joint when viewed in a transverse horizontal plane being thicker at the center thereof and tapering to its opposed side edges, said shell having a contour end edge terminating co-extensively with said seating and back portion and said joint, said back portion having opposed wing sections defined by opposed curvilinear concave end edges in a lower section thereof tapering progressively into said integrally formed joint, said seat portion also interconnecting with said joint along opposed curved end edges and merging with said side end of said back portion, said joint being disposed above a horizontal plane of said seating portion.

2. A shell as claimed in claim 1 wherein said joint has a width which is about 1/5 the total width of said back or seating portions.

3. A shell as claimed in claim 1 wherein said joint is about 8 times thicker than the average thickness of said back or seating portions.

4. A shell as claimed in claim 1 wherein said reinforced fibers are glass fibers, carbon fibers, or other suitable fibers.

5. A shell as claimed in claim 1 wherein said back portion and seating portion are of substantially equal lengths from the center of said joint which is disposed in a central region of said shell.

* * * * *